United States Patent [19]

Roderick, Sr., deceased et al.

[11] 4,264,275

[45] Apr. 28, 1981

[54] OAR

[76] Inventors: Donald Roderick, Sr., deceased, late of Grants Pass, Oreg.; by Dorothy R., administrator Menzies (formerly Roderick), 1538 Lomitos Ave., Livermore, Calif. 94550

[21] Appl. No.: 949,259

[22] Filed: Oct. 6, 1978

[51] Int. Cl.[3] ..... B63H 16/04

[52] U.S. Cl. ..... 416/74; 416/226

[58] Field of Search ..... 416/70, 74, 226, 223, 416/71; 115/24.1; 440/101

[56] References Cited

U.S. PATENT DOCUMENTS

| | | | |
|---|---|---|---|
| 684,868 | 10/1901 | Robison | 416/74 |
| 2,527,040 | 10/1950 | Swenson et al. | 416/74 |
| 2,600,048 | 6/1952 | Conwell | 416/226 |
| 2,711,547 | 6/1955 | Bliven | 416/74 |
| 3,091,781 | 6/1963 | Wisbrod | 416/70 |

*Primary Examiner*—Leonard E. Smith
*Attorney, Agent, or Firm*—William D. Stokes

[57] ABSTRACT

A simple, practical, easily manufactured, strong, lightweight boat oar having a shaft formed from metallic conduit with a grip attached to one end and paddle attached to the other end. The paddle is formed from two layers of metal welded together along their edges. The end of the shaft is formed in the shape of the interior surfaces of one end of the paddle and the paddle attached to the shaft at this point. A reinforcing strut is sandwiched between the two metal layers which form the paddle and the strut extends the length of the paddle. The strut is attached at one end to the shaft. Top and bottom reinforcement plates complete the attachment of the shaft to the paddle and insure that the paddle portion of the oar is watertight.

5 Claims, 6 Drawing Figures

OAR

FIELD OF THE INVENTION

The invention relates with particularity to the structure of an improved lightweight yet strong boat oar.

BACKGROUND OF THE INVENTION

There are many designs and constructions of oars in the prior art. These have included both all wooden, all metal and hybrid wooden and metal oars. Previous patents include U.S. Pat. No. 684,868 to Robison, issued Oct. 22, 1901; U.S. Pat. No. 358,034, to Green, issued Feb. 22, 1887; U.S. Pat. No. 1,401,864 to Bolton, issued Dec. 27, 1921; and U.S. Pat. No. 2,257,040 to Swenson et al, issued Oct. 24, 1950.

While these prior art oars certainly have served their purpose, there still remains a need for an oar which may be fabricated from lightweight malleable materials while having strength and durability for the arduous tasks oars are used for. To accommodate these seemingly inconsistent requirements, the oar of the present invention distributes the stress on the oar from rowing evenly along portions of its length which enables the use of extremely lightweight materials without a penalty in the strength and rigidity of the oar.

SUMMARY OF THE INVENTION

It is an object of this invention to provide an improved oar which is both light in weight and structurally strong.

It is another object of this invention to provide an improved oar which is designed to evenly distribute stresses along portions of its length.

Still another object of this invention is to provide an improved oar which may be contructed from lightweight metal components.

These and other objects are accomplished by an improved oar which is assembled from a handle shaft, a two-layer paddle and a reinforcing strut. The handle shaft and paddle are designed and attached in a manner to evenly distribute stress along an enlarged joint area. The reinforcing strut is sandwiched between two thin layers of metal which are welded together along their edges. The reinforcing strut is attached to the end of the handle shaft and extends along the length of the paddle in contact with the interior surfaces of the two paddle layers to evenly distribute the stresses of rowing along the entire length of the paddle.

BRIEF DESCRIPTION OF THE DRAWINGS

The novel features which are characteristic of this invention are set forth with particularity in the appended claims. The invention, together with further objects and advantages thereof may best be understood with reference to the following description when considered in conjunction with the accompanying drawings wherein:

DETAILED DESCRIPTION OF THE PREFERRED EMBODIMENT

Figure 1:
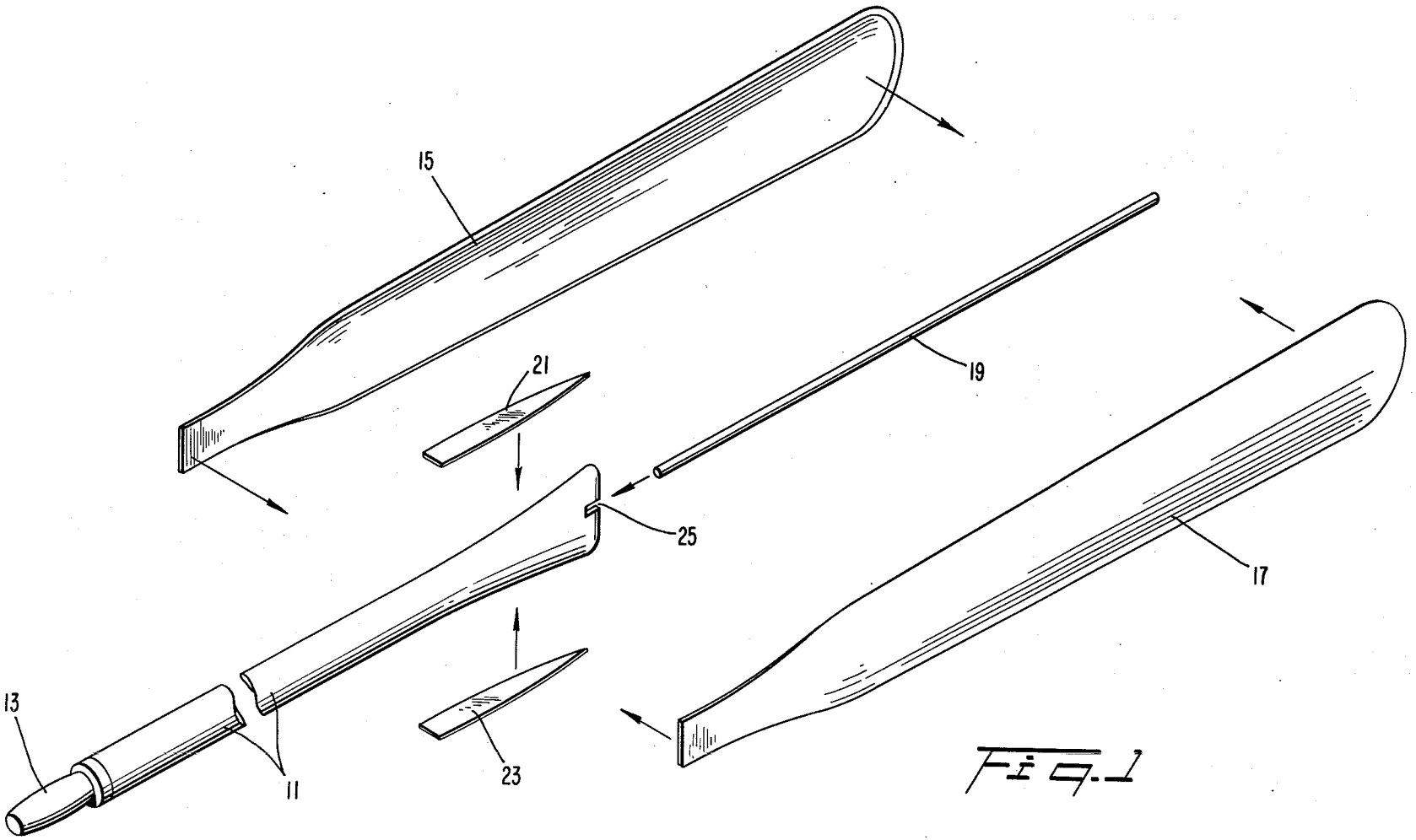
FIG. 1 is an exploded view of the oar of the invention.

FIG. 1 is an exploded view of the oar of the invention. The oar comprises a tubular metal shaft member 11 integrally connected at one end to a suitable wood, metal or plastic hand-grip 13. The other end of the shaft 11 is deformed to flare in a manner which conforms to the interior configuration of the blade members 15, 17. A notch 25 is provided in the flared end of shaft 11 for receiving and anchoring one end of a reinforcing strut 19. Two blade members 15, 17 are provided in the shape of paddles. The blade members 15, 17 are preferably strut aluminum such as aircraft quality aluminum so as to be thin, lightweight, malleable, and flexible. The use of strut aluminum permits the blade members 15, 17 to be easily deformed about the reinforcing strut 19 in a manner which would be more difficult when using a cast metal product. The shaft 11 is also preferably made from metal.

The edges of the blades 15, 17 are joined together as by welding during the construction of the oar. It is to be understood that the paddle member comprising blades 15 and 17 could be formed from a single tube member and molded. The shaft 11 is likewise joined or welded to the blades 15, 17 in a manner which will hereinafter be explained. A reinforcing rod or strut 19 is sandwiched between the blades 15, 17 prior to their edges being welded together. The strut 19 is made of a suitable strong material, for example metal, and is integrally connected to the closed end of shaft 11 at notch 25 by gluing, welding or other means. Sideplates 21 and 23 are attached to the shaft 11 and the blades 15, 17 to further reinforce the oar and to make the paddle portion watertight.

The handle shaft 11 of the oar is shown as broken away in FIG. 1. This is for purposes of illustrating only and one skilled in the art would understand that the length of the shaft can be selected according to the size of the boat and other factors. Also, appropriate oarlock connectors may be provided on the shaft 11 to anchor the oar to the boat.

Figure 2:
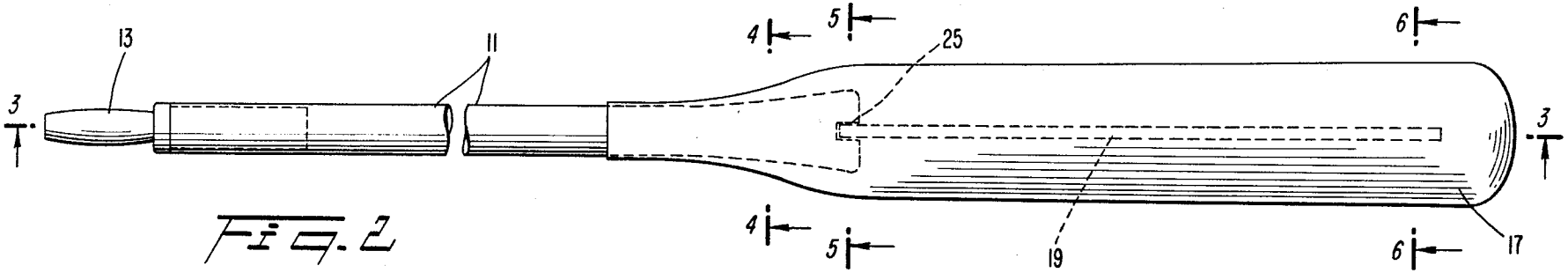
FIG. 2 is a profile view of the oar of the invention.
Figure 3:
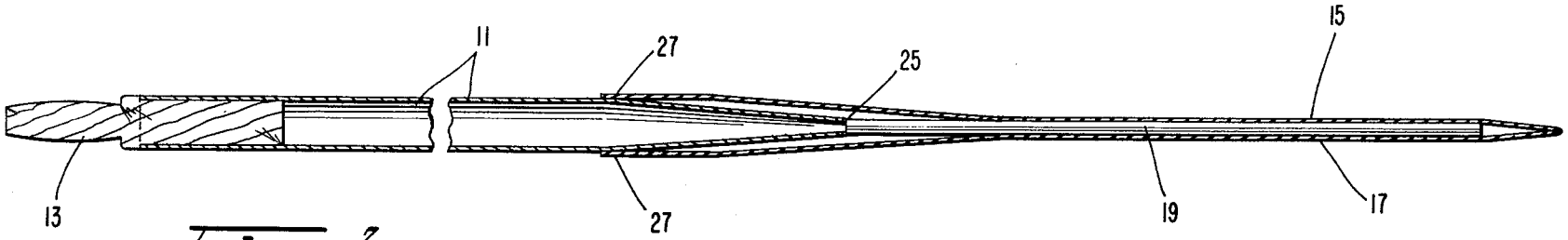
FIG. 3 is a cross-sectional view of the oar of FIG. 2 taken along the line 3—3.

FIG. 2 shows a side or profile view of the inventive oar with dotted lines for the interior construction. In FIG. 3, the oar of FIG. 2 is shown in cross-section and this drawing illustrates how the oar is designed to distribute stresses evenly along both the blades and the shaft to enable lighter materials to be employed in the manufacture of the oar.

FIG. 3 illustrates the refinforcing strut 19 in continuous contact with the interior walls of the blade members 15, 17 for substantially their entire length. This design causes any stress which bears upon the blades during rowing to be distributed along the entire lengths of the blades 15, 17 and the strut 19. It will be readily understood by one skilled in the art that distributing the force in the manner shown enables the blade portions 15, 17 to be contructed of lighter and thinner materials such as sheet aluminum without sacrificing rigidity and strength.

The shank portions of blades 15, 17 are welded or glued to the shaft 11 at points labeled 27. The shaft 11 is flared in this area to conform to the shape of the blades and to provide these elongated contacting portions 27 for locating the welds attaching the shaft 11 to the blades 15, 17. In the illustrated embodiment, the flared portion on the shaft 11 lengthens the contacting portion 27 to increase the area for the welds. This prevents any stress from being concentrated at one point of contact, but rather distributes the stress along the full length of the welds.

Figure 4:
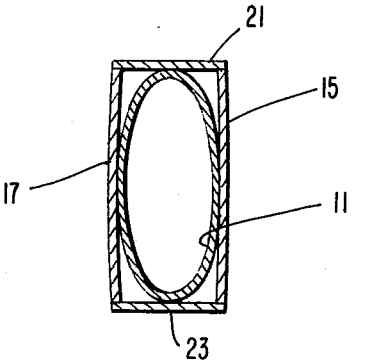
FIG. 4 is a cross-sectional view of the oar of FIG. 2 taken along the line 4—4.

The oar of FIG. 2 is shown in a different cross-section in FIG. 4. This view shows the reinforcing contact between the flared end of the shaft 11 and the shank portion of blades 15, 17. In the illustrated embodiment the ends of the blades 15, 17 form a rectangle when welded together and enclose the oval-shaped shaft 11 with four points of contact for the welds.

Figure 5:
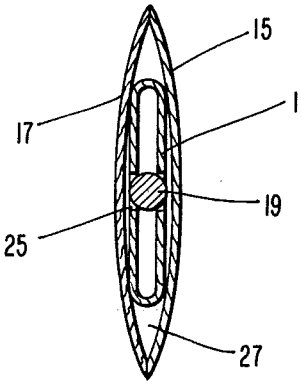
FIG. 5 is a cross-sectional view of the oar of FIG. 2 taken along the line 5—5.

In FIG. 5, the cross-section shows the strut 19 in juxtaposition to shaft 11. The shaft 11 continues to provide a support surface in contact with the blades 15, 17 to provide support and welding locations. The reinforcing strut 19 further reinforces the shaft 11 and the blades 15, 17.

Figure 6:
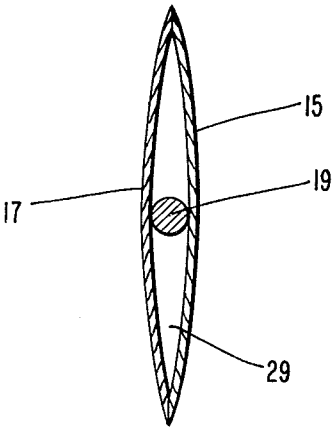
FIG. 6 is a cross-sectional view of the oar of FIG. 2 taken along the line 6—6.

The relationship of the reinforcing strut 19 to the blades 15, 17 is shown in FIG. 6. The strut is continuously tangent to the blades 15, 17 to support the blades and to distribute the stresses of rowing along the length of the strut 19 and the blades 15, 17. The interior of the paddle also defines flotation chambers 29 which which when combined with the light weight of the oar confers a natural buoyancy.

The inventive oar as illustrated and described provides a novel structure which adds strength to the oar without adding weight. This strength arises in part from a reinforcing strut which is in contact with the interior surfaces of two blade members for a substantial portion of their lengths to serve as a force distributing member. The increased strength is a further result of the extended contact between the interior surfaces of the blade member and and the flared portion of the oar shaft. The use of lightweight strut aluminum is also contemplated with the two struts forming the blade being deformed at their center by the reinforcing strut. Thus, it can be readily seen that the structure of the instant oar prevents the application of damaging stress at any single point and distributes the stress of rowing over a plurality of surfaces to enable lightweight material to be employed without a degradation in oar strength.

The foregoing description of an oar is intended to be explanatory of a preferred embodiment for implementing the instant invention. One skilled in the art would understand that changes could be made without departing from the spirit of the invention. The scope of the invention is defined by the following claims.

What is claimed is:

1. A lightweight, reinforced boat oar comprising;

a paddle formed by two layers of strut aluminum joined together at their edges;

sideplate reinforcing means;

handle shaft joined to said paddle at a plurality of locations by a plurality of welds, said sideplate reinforcing means attached to said shaft and said paddle for reinforcing the attachment of said paddle to said shaft; and force distributing means joined to said shaft and sandwiched between the two layers of strut aluminum, said force distributing means extending substantially through the length of said paddle to distribute stress on said layers of aluminum along the length of said force distributing means.

2. A lightweight, reinfoced boat oar comprising:

hand grip means;

first blade means having a tapered planar portion;

a second blade means having a tapered planar portion, said first and second blade means being joined to form a paddle having a tapered end;

shaft means attached at one end to said handgrip means and having its other end closed and flattened to conform substantially to the planar interior surfaces of said tapered end of said paddle, said conforming portion of said shaft being joined to the tapered end of said interior surfaces of said paddle over an extended length;

strut means having an end joined to the shaped end of said shaft means and extending through the length of said paddle, said strut means being in continuous contact with the interior surfaces of said first blade means and said second blade means whereby said strut means and said extended joining of said shaft to said paddle distributes stress on said paddle evenly along the paddle, the reinforcing means and said shaft.

3. The oar of claim 2 further including a first sideplate and a second sideplate, each of said sideplates being joined to said shaft and said paddle for additionally reinforcing said paddle.

4. The oar of claim 2 wherein said first blade means and said second blade means are made from strut aluminum.

5. The oar of claim 4 wherein said first blade means and said second blade means are joined by welds and wherein said paddle is joined to said shaft by welds.

* * * * *